US006296228B1

(12) United States Patent
Knowles et al.

(10) Patent No.: US 6,296,228 B1
(45) **Date of Patent: *Oct. 2, 2001**

(54) SERVICE DEVICE

(75) Inventors: Steven M. Knowles, Silver Lake, IN (US); Terrence D. Kalley, Troy, MI (US)

(73) Assignee: Prime Solutions, LLC, Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/604,788

(22) Filed: Jun. 28, 2000

Related U.S. Application Data

(63) Continuation-in-part of application No. 09/448,610, filed on Nov. 24, 1999, now Pat. No. 6,250,603.

(51) Int. Cl.[7] ..... F16K 51/00; F17D 65/72

(52) U.S. Cl. ..... 251/149.1; 251/149.6; 137/614.05

(58) Field of Search ..... 251/149.1, 149.6; 137/614.02, 614.05

(56) References Cited

U.S. PATENT DOCUMENTS

| | | | | |
|---|---|---|---|---|
| 3,592,439 | | 7/1971 | Ritchie, Jr. | 251/149.6 |
| 3,777,771 | * | 12/1973 | De Visscher | 137/1 |
| 4,017,057 | | 4/1977 | Strybel | 251/149.1 |
| 4,328,948 | | 5/1982 | Pearl, II | 251/149.6 |
| 5,139,049 | | 8/1992 | Jensen et al. | 137/614.05 |
| 5,244,010 | | 9/1993 | Barjasteh et al. | 137/614.05 |
| 5,293,902 | | 3/1994 | Lapierie | 137/614.04 |
| 5,312,084 | * | 5/1994 | Weh | 251/148 |
| 5,370,359 | | 12/1994 | Sadegh et al. | 251/276 |
| 5,370,527 | | 12/1994 | Hefling et al. | 431/247 |
| 5,388,634 | * | 2/1995 | Weinstien et al. | 165/78 |
| 5,450,875 | | 9/1995 | Chichester et al. | 137/614.05 |
| 5,725,025 | * | 3/1998 | Park et al. | 137/872 |
| 5,975,490 | | 11/1999 | Essman | 251/149.4 |

OTHER PUBLICATIONS

"R134a Couplers, Replacement Guages, Gauge Protectors," Mastercool brochure (undated).

* cited by examiner

*Primary Examiner*—Kevin Shaver
*Assistant Examiner*—David A Bonderer
(74) *Attorney, Agent, or Firm*—Fish & Richardson P.C.

(57) ABSTRACT

A service device connects to a service port of a pressurized system. The device includes a valve opening member for opening a valve within the port. The position of the valve opening member within the connector is adjustable or self-adjusting. The adjustable valve opening member allows the valve in the service port to be opened fully by the connector over a range of valve positions within the port. The device can attach to a service unit for servicing the pressurized system. The system can be an air conditioning or refrigeration system.

36 Claims, 7 Drawing Sheets

SERVICE DEVICE

CLAIM OF PRIORITY

This application is a continuation-in-part of U.S. patent application Ser. No. 09/448,610, filed on Nov. 24, 1999 now U.S. Pat. No. 6,250,603 , the entire contents of which are hereby incorporated by reference.

TECHNICAL FIELD

The invention relates a device for servicing a pressurized system, in particular an air conditioning or refrigeration system.

BACKGROUND

Service devices, such as service couplings, are commonly employed to facilitate charging and evacuation of a pressurized fluid system, such as a refrigeration system, an air conditioning system, or a hydraulic system. The service device connects to a service port of the system. The service device opens a valve within the service port, allowing fluids, including liquids or gases, to be exchanged with the system. For example, when servicing a refrigeration or air conditioning system, the service device can be connected by a flexible hose to a refrigerant supply source, such as a pressurized bottle or cylinder or a recovery and recycle station. When the service device and valve within the service port are opened, refrigerant can flow through the connection and into the refrigeration or air conditioning system.

In air conditioning systems, system performance can deteriorate when air is in the system. In addition, introduction of air can also lead to introduction of moisture and other contaminants into the system. Thus, keeping air out of the system can be important when servicing a system.

In order to properly open a valve within the service port, the valve must be positioned properly within the service port so that the service device can open the valve when connected to the port. Deviations in valve position within the port can cause the service device to improperly open the valve, fail to open the valve, or damage the valve by applying excessive pressure to the valve.

SUMMARY

The invention features a service device for connecting to a service port of a pressurized system. The pressurized system can be a climate control system (e.g., an air conditioning or refrigeration system), a brake system, a hydraulic system, or a service device for servicing a climate control system. The device includes a valve opening member for opening a valve within the port. The position of the valve opening member within the device is adjustable or can be self-adjusting. The adjustable valve opening member allows the valve in the service port to be opened properly by the device upon attachment to the port over a range of valve positions within the port.

The device can include a purge feature to purge air directly from a service line, reducing the amount of air introduced into the system during servicing. The device can also include a self-sealing valve assembly that prevents opening the coupling member until a proper coupling interconnection with a system to be serviced has taken place, which can reduce fluid loss or injury. The device can be constructed from metal, such as, for example, brass, steel, stainless steel, or aluminum.

In one aspect, the invention features a service device. The device includes a body and a valve opening member. The body has a first end engageable with a service port including a valve. The body also includes a second end engageable with a service unit, and an inner surface defining an interior chamber. The first end and the second end are in fluid communication through the interior chamber. The valve opening member is disposed in the interior chamber. The body can be a portion of a coupling device. The first end can be engageable with a high pressure side refrigerant port or a low pressure side refrigerant port.

The valve opening member includes a valve actuating end proximate to the first end. The valve actuating end is capable of changing position relative to the first end. The valve actuating end is configured to open the valve as the first end is engaged with the port. The valve opening member can be arranged to depress a pin within the valve when engaged with the port. The first end can be capable of forming a seal with the port when it is engaged with the port. The device can include a sealing gasket between the body and the first end. The device can include a threaded fitting or a quick connect fitting at the first end for engaging it with the port. The quick connect fitting secures the device to the port by pressing the device onto the port.

In certain embodiments, the valve opening member is engageable with a tool for changing the position of the valve actuating end relative to the first end. The valve opening member and the inner surface of the body can be threaded. The position of the valve opening member can be adjusted using a tool.

In other embodiments, the service device includes a spring within the body. The valve opening member is biased by the spring toward the first end. The position of the valve opening member can be adjusted by pressing the valve of the port against the member to compress the spring. The spring can be less compressible than the pin. The spring can be rigid enough to overcome resistance to pressing the pin due to a spring in the pin and pressure in the system.

In other embodiments, the second end of the body is engaged with a service unit and the valve opening member is in a fixed position relative to the service unit. The service unit can be a service manifold, a valve core removal tool, a refrigerant cylinder, a fluid charge line, such as a hose, a refrigerant identifier or analyzer, a diagnosis instrument, a dye injector, a recovery and recycle station, or other device that can connect to a service port of a system. The second end can be movably engaged with the service unit. Movement of the body relative to the service unit can change the position of the valve actuating end relative to the first end. For example, the second end of the body can be connected to the device by threading, and the body or service device can be rotated to change the position of the valve actuating end. A button, a switch, a lever, a knob, or a rocker can be used to move the valve actuating end relative to the first end.

In other embodiments, the first end of the body can include a release sleeve assembly including an adapter connected to the first end of the body, a release sleeve over the adapter, and a spring between the release sleeve and the adapter. The release sleeve assembly can include a plurality of balls distributed between the adapter and the sleeve, the balls being engageable with the service port. The adapter can be connected by threads, pins, one or more set screws, a snap ring, brazing, or soldering. The plurality of balls can include six or more balls (e.g., eight balls).

The service device can also include a pin depressor proximate to the second end having a first position oriented closer to the interior chamber relative to a second position which is closer to the service port, the pin depressor moving from the first position to the second position when the service port is engaged with the first end of the body, and the pin depressor being in the first position when the first end of the body is not engaged with the service port. The pin depressor can be movably attached to a pusher disposed in the interior chamber. A valve can be positioned within the second end, the valve being opened when the pin depressor moves from the first position to the second position. The service device can also include a valve detection member movably disposed on a pusher within the internal chamber. The valve detection member moves relative to the pusher when the service port is engaged with the first end of the body. The pin depressor moves from the first position to the second position when the valve detection member moves relative to the valve actuation portion.

The service device can include a purge actuator exterior to the body. The purge actuator can have a shaft extending through the interior chamber to the port, the shaft being capable of moving a pin depressor from a first position to a second position. The purge actuator can include a button, a switch, a lever, a knob, or a rocker.

In another aspect, the invention features a coupling member including a body, a valve opening member, a valve detection member, a pin depressor. The body has a first end engageable with a service port including a first valve, an inner surface defining an interior chamber, and a second end in fluid communication with the interior chamber and the first end. The valve opening member extends toward the first end of the body and is movably disposed on a pusher within the interior chamber. The valve detection member is movably disposed on the pusher. The valve detection member moves relative to the pusher when the service port is engaged with the first end of the body. The valve detection member is substantially stationary relative to the pusher when the first end of the body is not engaged with the service port. The pin depressor is movably attached to the pusher and proximate to the second end. The pin depressor has a first position oriented closer to the interior chamber relative to a second position which is closer to the second end. The pin depressor moves from the first position to the second position when the valve detection member moves relative to the pusher.

In another aspect, the invention features an air conditioning or refrigeration service device including a first end engageable with a service port including a valve, a valve opening member disposed within the service device, the valve opening member including a valve actuating end proximate to the first end, and the valve actuating end being capable of changing position relative to the first end, and a spring within the device biased to position the valve opening member toward the first end.

In another aspect, the invention features a method of opening a service port. The method includes adjusting a position of a valve actuating end of a valve opening member relative to a first end of a service device and opening a valve within the service port. The valve actuating end is capable of being positioned relative to the first end to open the valve as the first end is engaged with the port. The valve opening member is within the device. The first end is engageable with the service port. The service device can be attached to a service device. When the device is attached to a service device, the device can be an integrated portion of the service device or it can be separable from the service device. Alternatively, the service device can be capable of attaching to a service device. In certain embodiments, the method includes sealing the device to the port prior to or concurrently with opening the valve. Adjusting can be self-adjusting, which takes place upon attaching the service device to the service port.

Adjusting can include changing the position of the valve actuating end relative to the first end with a tool or moving the valve opening member relative to the first end against a spring, the spring being biased to position the valve opening member toward the first end. Alternatively, the device can include a second end engaged with a service unit and the valve opening member can be in a fixed position relative to the service unit. When the valve opening member can be in a fixed position relative to the service unit, adjusting can include moving the second end relative to the service unit to change the position of the valve actuating end relative to the first end. Since the movement is relative, either the body or the service unit can be moved to change the position of the valve actuating end relative to the first end. Adjusting can include moving the valve opening member relative to the first end against a spring, the spring being biased to position the valve opening member toward the first end. The spring can be less compressible than a pin in the valve of the service port.

In another aspect, the invention features a method of servicing a pressurized fluid system including attaching a coupling member to a service port of the system, the coupling member including a self-adjusting valve opening member and opening the service port by attaching the coupling member to the service port. The self-adjusting valve opening member applies adequate pressure to open the valve without damaging it. The service port can be a high pressure side refrigerant port or a low pressure side refrigerant port. The coupling member can be connected to a service unit.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
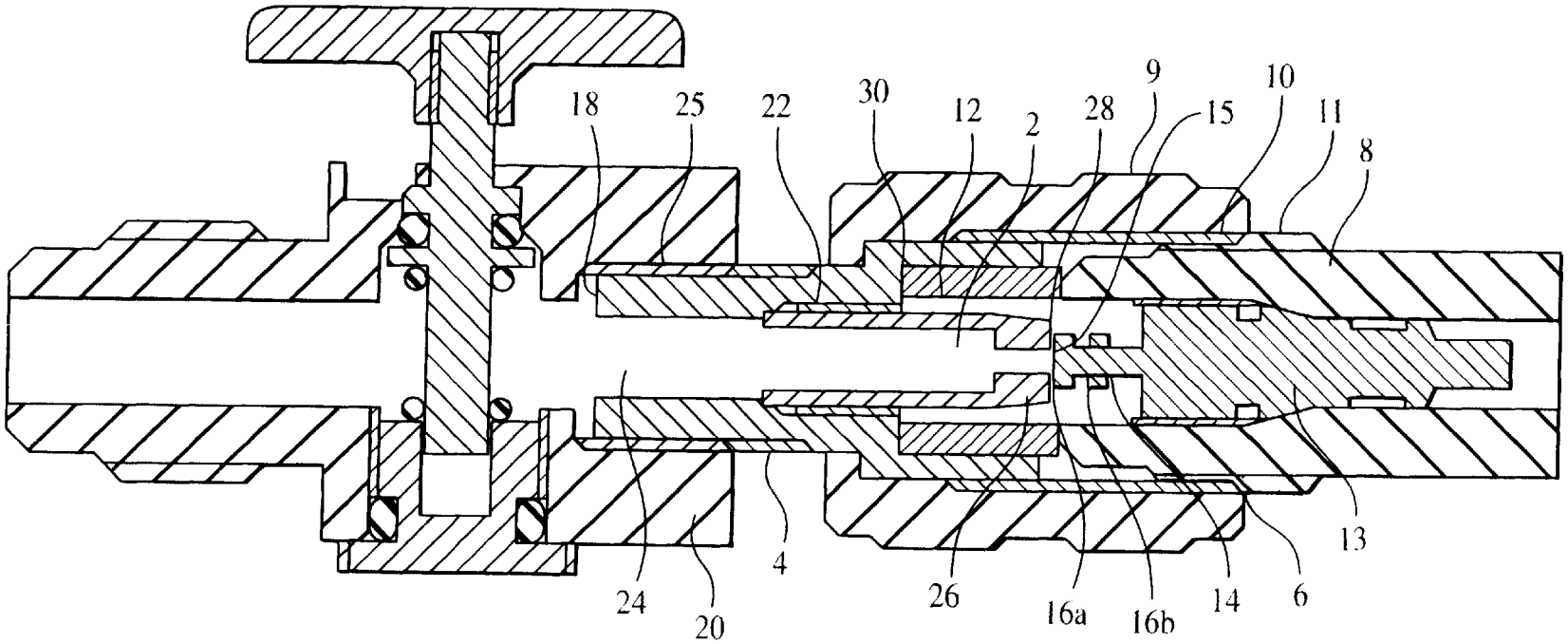
FIG. 1 is a schematic drawing depicting a sectional view of a device that is adjustable with a tool.

Referring to FIGS. 1–4, service port connector 2 includes body 4. Body 4 has first end 6 engageable with service port 8. Swivel nut 9 connects body 4 to port 8 via threaded surface 10 which mates with threads 11 on the outer surface of port 8. Alternatively, the body can connect to the port by a snap-on fitting, in which a release sleeve snaps onto the port to engage the connector with the port. The snap-on fitting secures to the port with steel balls that settle into a groove on the port. Connector 2 also includes sealing gasket 12, which forms a gas-tight seal with port 8 as end 6 is engaged with port 8. Because the system typically contains pressurized fluids, the connector can form a seal with the port prior to opening the valve. Service port 8 can be a high pressure-side refrigerant port or low pressure-side refrigerant port, such as a male R12 port (as shown). As an alternative to the R12 port, the port can be a R134*a* port, a 14 mm port, a ¼ inch flare port, a ⅜ inch flare port, or a ½ inch ACME port, or other fitting typically used in air conditioning or refrigeration systems. The connector can be adapted to mate with Society of Automotive Engineers (SAE)-dimensioned ports and can be constructed from metal, such as, for example, brass, steel, stainless steel, or aluminum, for durability.

Service port 8 includes valve 13, which can be a Schrader-type valve (as shown). Valve 13 contains pin 14 which when actuated by pressing into the valve opens the valve. The position of valve 13 within port 8 can vary. As a result, the position of end 15 of pin 14 can vary between minimum position 16*a* and maximum position 16*b*. The variation in pin end position between position 16*a* and 16*b* can be outside the tolerances suggested by the SAE or the American Refrigeration Institute (ARI). The variation in pin end position can be up to 50 thousandths of an inch outside the specified tolerances, more typically up to 40 thousandths of an inch outside the specified tolerances. For example, for a R12 port, the variation in pin end position between position 16*a* and 16*b* can be 50 to 60 thousandths of an inch, which is outside the SAE specifications. The valve position within other ports can vary by different amounts, as described by the specified tolerances. The adjustable valve actuating end within the connector allows ports containing valves outside the specified tolerances, as well as those within the specified tolerances, to be opened by the connector.

Body 4 has second end 18, which engages with service unit 20. Body 4 also has inner surface 22, which defines interior chamber 24, through which first end 6 and the second end 18 are in fluid communication. Outer body surface 25 connects to service unit 20 via threaded surfaces. Alternatively, outer body surface 25 can be connected to service unit 20 by pins, set screws, a snap ring, brazing, or soldering or body 4 can be an integral part of service unit 20. Service unit 20 can be a portion of an air conditioning or refrigeration service device, such as the purge device shown in FIGS. 1–4, or a service manifold, a coupling member, a valve core removal tool, a refrigerant cylinder, a fluid charge line, such as a hose, an anti-blow back valve, a refrigerant identifier or analyzer, a diagnosis instrument, a dye injector, a recovery and recycle station, or other device that can connect to a service port of an air conditioning or refrigeration system.

Valve opening member 26 is disposed in interior chamber 24. Valve opening member 26 has valve actuating end 28. Valve actuating end 28 is located proximate to first end 6 and is capable of changing position relative to first end 6. As port 8 is inserted into first end 6, a seal is formed between port 8 and sealing gasket 12. Valve actuating end 28 contacts end 15 of pin 14, depressing it and opening valve 13. When attachment of connector 2 to port 8 is complete, pin 14 is completely depressed so that valve 13 is fully opened.

As noted above, the position of valve 13 within port 8 can vary such that the position of end 15 with respect to the port can vary up to 50 thousandths of an inch out of specified tolerances. If the valve is positioned so that end 15 is at position 16*a* the valve may be opened prematurely, and if the valve is positioned so that end 15 is at position 16*b* the valve may not be opened. The position of valve opening member 26, and valve actuating end 28, relative to first end 6 is adjustable. Adjustment of the position can allow the user to open the valve properly when the connector is attached to the port. In addition, this adjustment can help reduce or avoid potential damage to the valve by applying excessive pressure to the valve, help reduce or avoid leakage of fluid from the connector due to incomplete sealing before opening the valve, or help reduce or avoid decreased fluid flow from incomplete opening of the valve.

Referring to FIG. 1, inner surface 22 of body 4 and outer surface 30 of valve opening member 26 are threaded. The position of valve opening member 26 within body 4 can be adjusted by rotating valve opening member 26 along the threads. The threads not only hold valve opening member 26 within the body, they allow the position of the member to vary. The position can vary by up to 50 thousandths of an inch. This allows the position of member 26, and valve actuating end 28, to be adjusted so that valve 13 of port 8 can be opened properly. The member position can be adjusted by changing the position of valve actuating end 28 relative to first end 6 using a tool. For example, valve actuating end 28 can be shaped to interface with a valve core removal tool, such as part 10987 available from Robinair, Montpelier, Ohio, which can be inserted into end 6 and twisted to change the member position.

Figure 2:
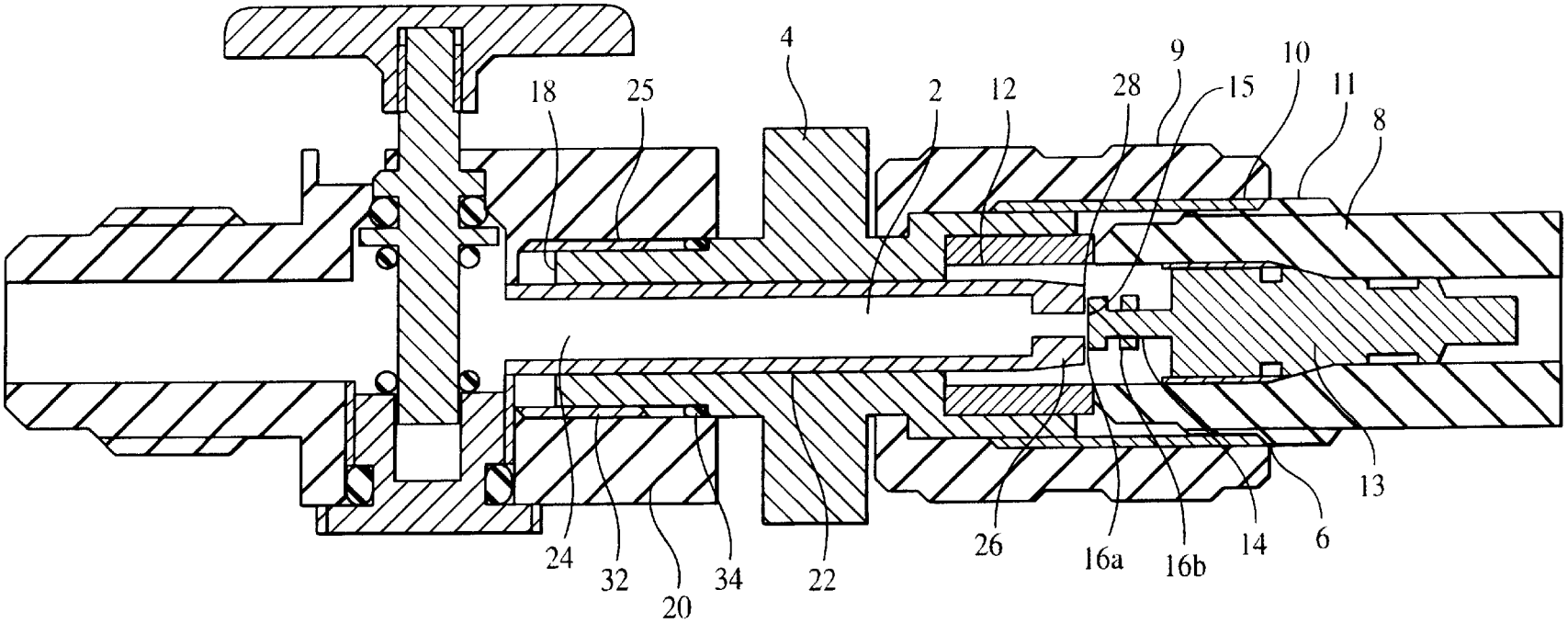
FIG. 2 is a schematic drawing depicting a sectional view of a device that is manually adjustable without a tool.

The connector can be configured to adjust the position of valve opening member 26 relative to first end 6 using an adjustable body. Referring to FIG. 2, connector 2 is attached to service unit 20 via second end 18. Device 20 and second end 18 are movably engaged by threads on outer body surface 25 and inner device surface 32. O-ring 34 forms a gas-tight seal between body 4 and device 20. Valve opening member 26 is fixed in position within device 20. Movement of body 4 relative to service unit 20, by rotating along the threads changes the position of valve actuating end 28 relative to first end 6, allowing valve 13 to be opened properly when port 8 is attached to connector 2. The configuration of FIG. 2 allows the member position to be adjusted while port 8 is attached to connector 2.

Figure 3:
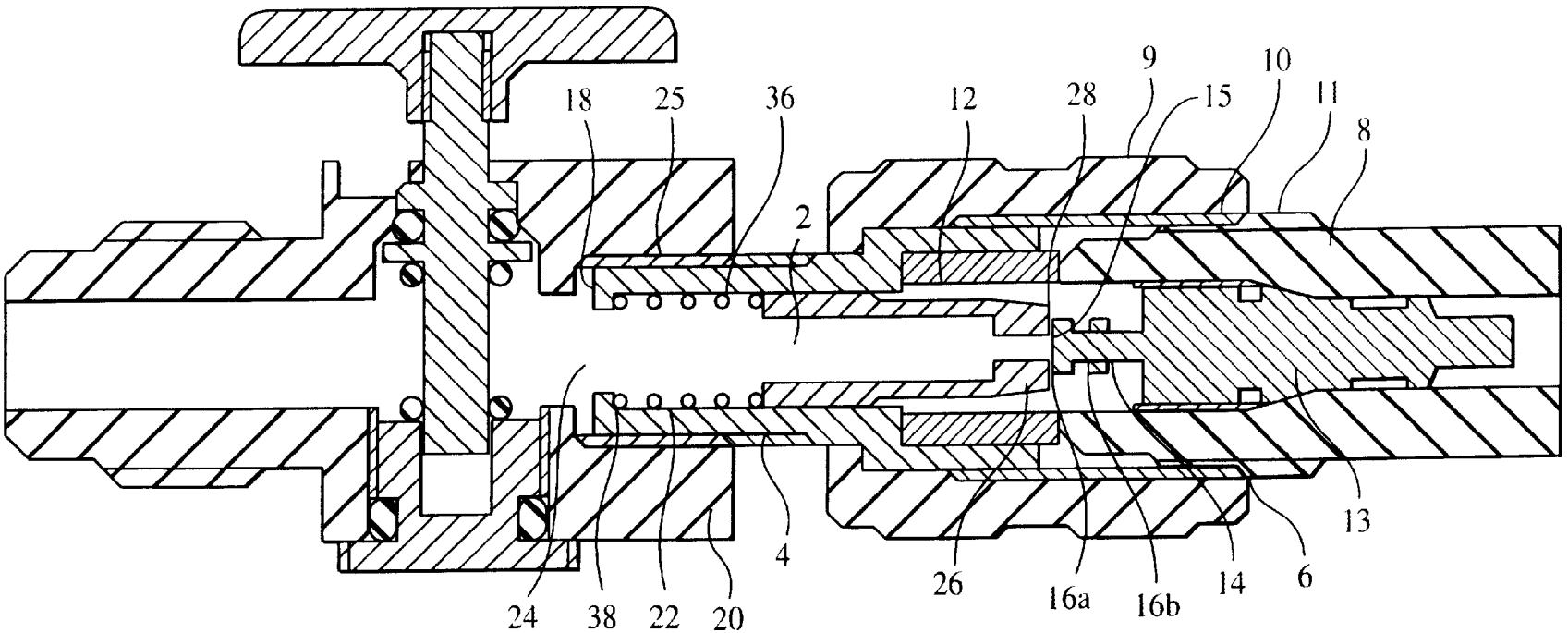
FIG. 3 is a schematic drawing depicting a sectional view of a device that is adjustable automatically.

In a third configuration, the position of valve opening member 26 adjusts automatically within body 4. Referring to FIG. 3, spring 36 is positioned between valve opening member 26 and lip 38 of body 4. Spring 36 allows the position of valve actuating end 28 relative to first end 6 to float, and biases member 26 toward first end 6. Floating allows the position of valve opening member 26 to be maintained when contacting pin end 15 as port 8 is inserted into first end 6, thereby opening valve 13. Accordingly, spring 36 is less compressible than pin 14. When valve 13 is completely open, spring 36 compresses, allowing member 26 to retract into body 4 and permitting a better seal to form between connector 2 and port 8. When port 8 is not engaged with first end 6, valve actuation end 28 is positioned relative to first end 6 so that it contacts pin end 15 in position 16*a* when port 8 first seals against seal 12.

Figure 4:
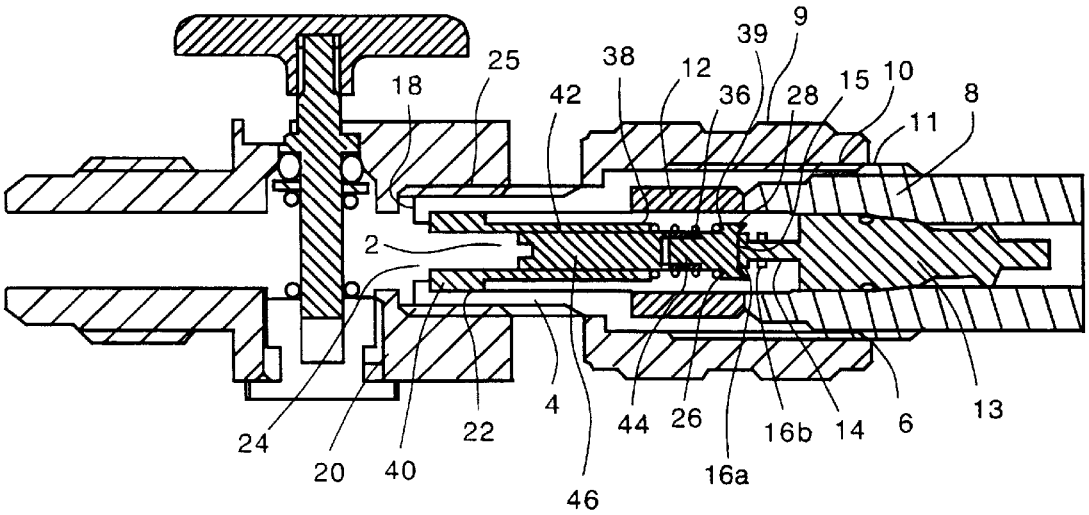
FIG. 4 is a schematic drawing depicting a sectional view of a device that is adjustable automatically.

In another embodiment of a self-adjusting valve opening member, FIG. 4 depicts valve opening member 26, which slides in pusher 40 and is biased toward first end 6 by spring 36. Spring 36 is positioned between lip 38 of pusher 40 and step 39. Pusher 40 is secured to body 4. Spring 36 allows the position of valve actuating end 28 relative to first end 6 to float. Floating allows the position of valve opening member 26 to be maintained when contacting pin end 15 as port 8 is inserted into first end 6, thereby opening valve 13. Valve 13 of service port 8 can be a primary seal-type valve, such as a Schrader-type valve. In order to open valve 13 in this manner, spring 36 is less compressible than pin 14. When valve 13 is completely open, spring 36 compresses, allowing member 26 to retract into pusher 40 and permitting a better seal to form between connector 2 and port 8. When port 8 is not engaged with first end 6, member 26 is fully extended, resting against stop 42. In this configuration, valve actuation end 28 is positioned relative to first end 6 so that it contacts pin end 15 in position 16*a* when port 8 first seals against seal 12. Member 26 is composed of front portion 44, which is threadably engaged with rear portion 46.

The service device can be a coupling, such as the coupling described in U.S. patent application Ser. No. 09/422,236, filed Oct. 21, 1999, the entire contents of which are hereby incorporated by reference.

Figure 5:
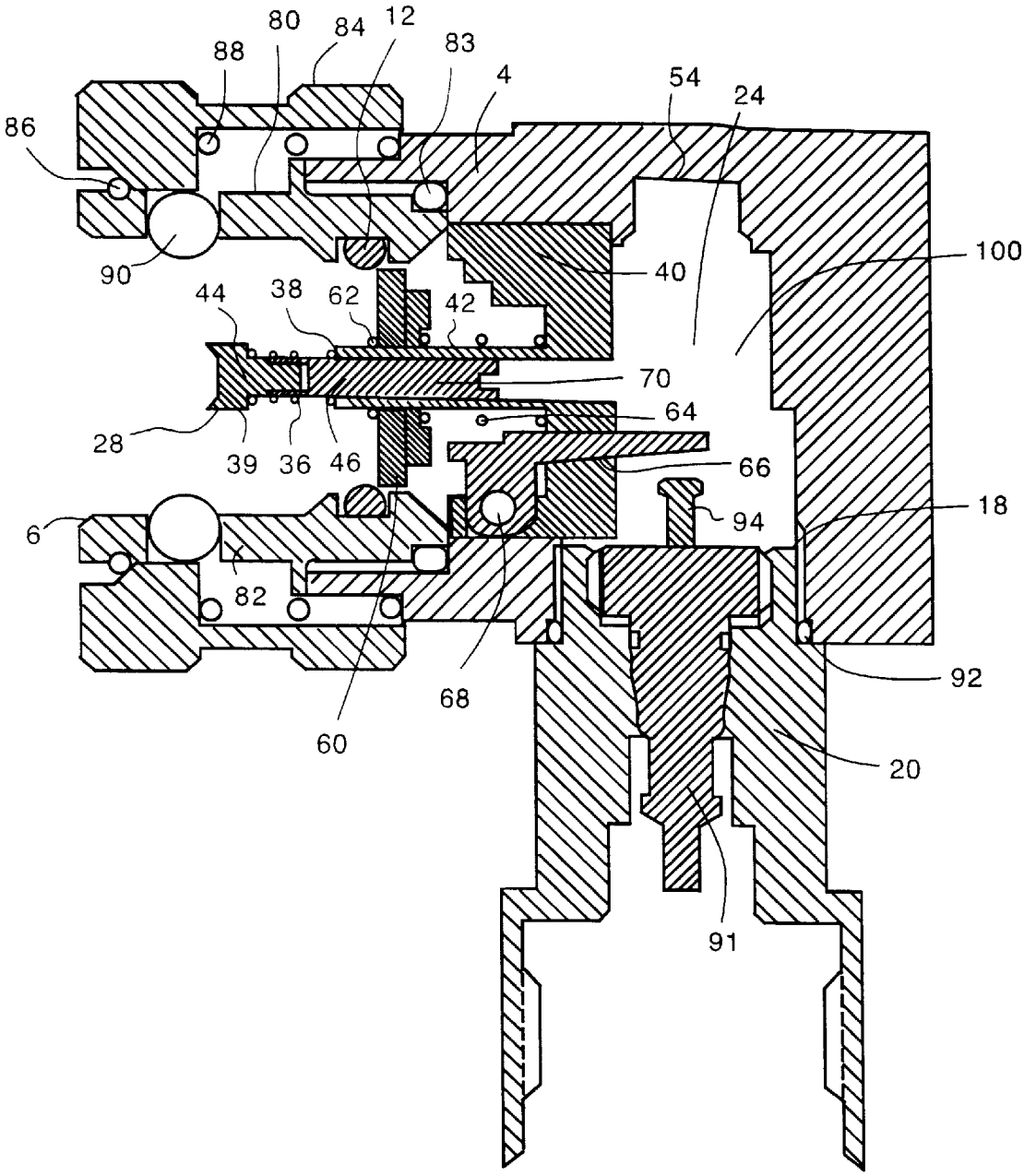
FIG. 5 is a schematic drawing depicting a sectional view of a coupling member.
Figure 6:
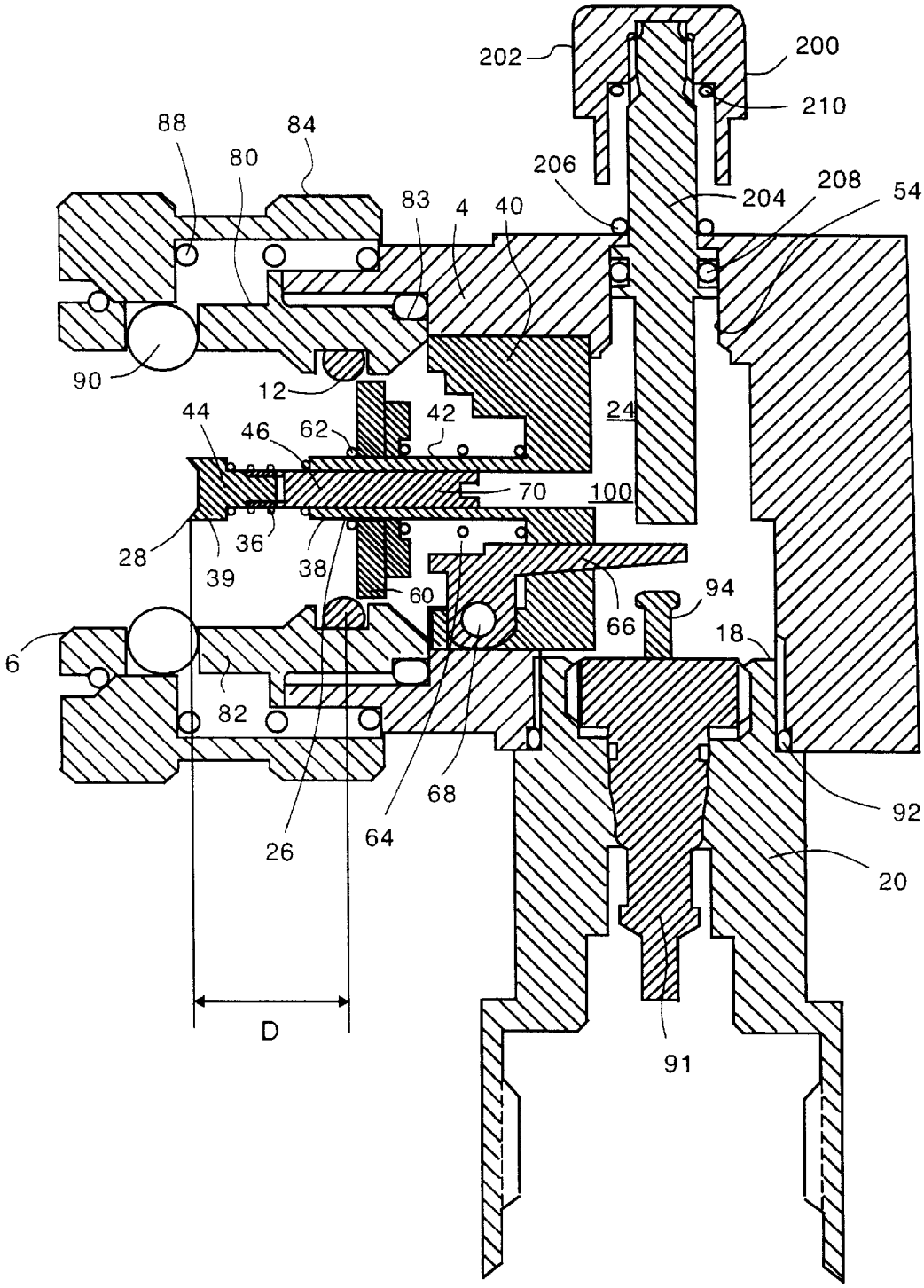
FIG. 6 is a schematic drawing depicting a sectional view of a coupling member.
Figure 7:
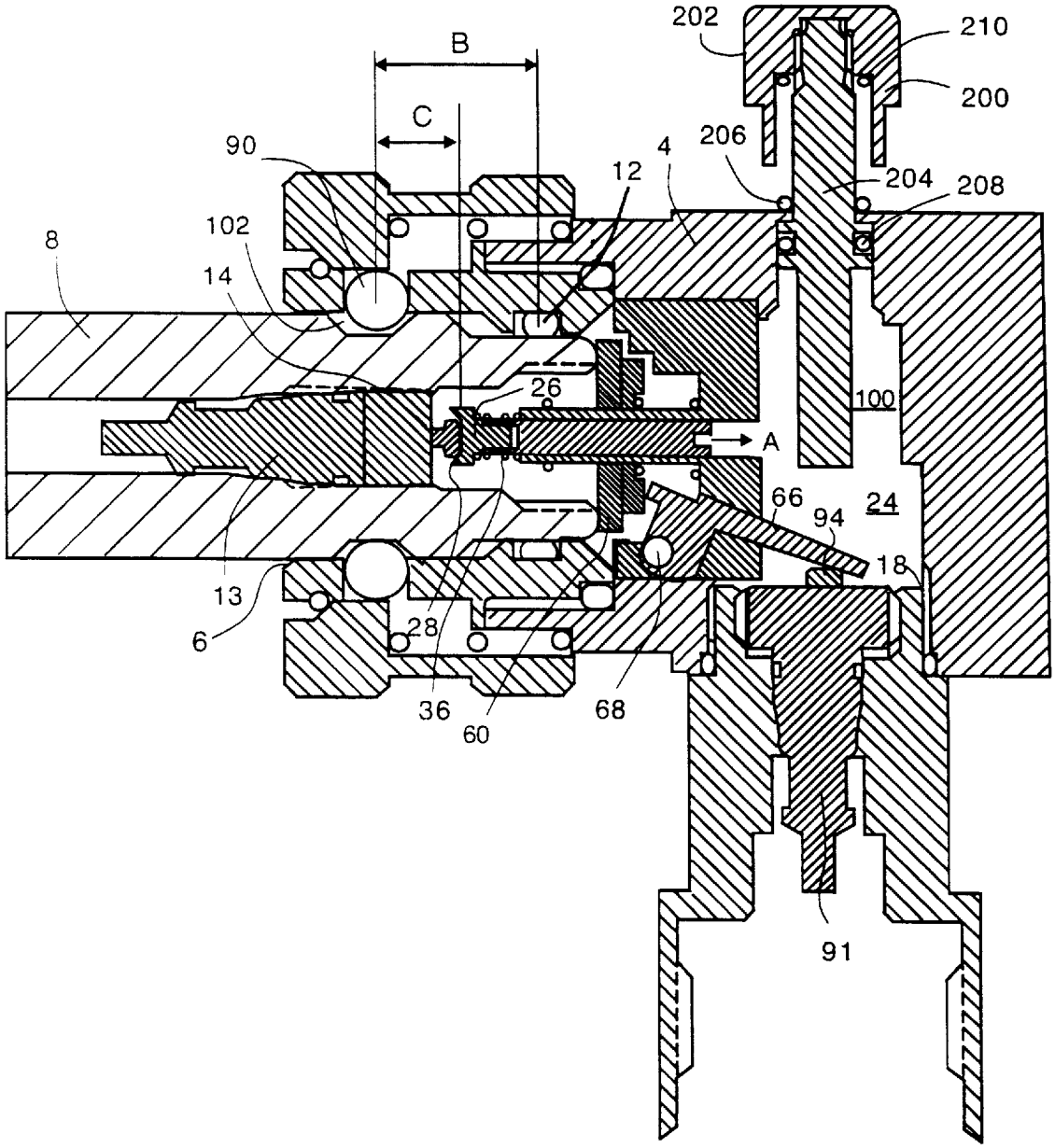
FIG. 7 is a schematic drawing depicting a sectional view of a coupling member engaged with a port.

Referring to FIGS. 5–7, coupling member 100 includes body 4. Body 4 has first end 6 attached to release sleeve assembly 80. Release sleeve assembly 80 includes adapter 82, which is attached by threads to first end 6. Alternatively, adapter 82 can be attached to first end 6 by pins, set screws, a snap ring, brazing, soldering, or swaging. O-ring 83 provides a fluid-tight seal between adapter 82 and body 4. Release sleeve 84 slides over adapter 82. Retaining ring 86 holds release sleeve 84 over adapter 82. Release sleeve spring 88 resides between release sleeve 84 and adapter 82 and pushes release sleeve 84 against retaining ring 86. Release sleeve 84 holds balls 90 within adapter 82. Balls 90 are distributed around the circumference of adapter 82. First end 6 can receive a service port, which includes a valve, of a pressurized system.

Valve opening member 26 slides in pusher 40 and is biased toward first end 6 by spring 36. Spring 36 is positioned between lip 38 of pusher 40 and step 39. Pusher 40 is disposed in interior chamber 24 of body 4. Interior chamber 24 is defined by inner surface 54 of body 4. Pusher 40 is secured to body 4. Spring 36 allows the position of valve actuating end 28 relative to first end 6 to float. Member 36 is composed of front portion 44, which is threadably engaged with rear portion 46. Referring to FIG. 7, in which valve 13 is shown at a minimum SAE depth, floating allows the position of valve opening member 26 to be maintained when contacting pin end 15 as port 8 is inserted into first end 6, thereby opening valve 13. In order to open valve 13 in this manner, spring 36 is less compressible than pin 14. When valve 13 is completely open, spring 36 compresses, allowing member 26 to retract into pusher 40 and permitting a better seal to form between connector 2 and port 8, compensating for the depth of port 8. Referring to FIGS. 5 and 6, when the port is not engaged with first end 6, member 26 is fully extended, resting against stop 42. In this configuration, valve actuation end 28 is positioned relative to first end 6 so that it contacts pin end of the valve in the port in minimum position when port 8 first seals against seal 12.

Referring to FIGS. 5–7, pusher 40 has valve opening member 26 extending toward first end 6. Valve opening member 26 supports valve detection member 60. Valve detection member 60 is a ring surrounding valve opening member 26 and is slideably disposed on valve opening member 26. Valve detection member 60 is held on valve opening member 26 by retaining ring 62. Spring 64, also located on valve opening member 26 biases valve detection member 60 along valve opening member 26 toward retaining ring 62.

Body 4 also includes second end 18, which is in fluid communication with interior chamber 24 and first end 6. Second end 18 includes service unit 20, which includes valve 91. Service unit 20 can be a 14 mm connector (as shown). The connector can be combined with a 14 mm male port, a 14 mm female port, a ¼ inch male flare port, a ¼ inch female flare port, a ⅜ inch male flare port, a ⅜ inch female flare port, a ½ inch ACME male port, or a ½ inch ACME female port. O-ring 92 provides a fluid-tight seal between service unit 20 and body 4. Valve 91 has poppet 94 which opens valve 91 when depressed.

Pin depressor 66 is located within interior chamber 24 and proximate to second end 18. Pin depressor 66 is fixed to pusher 40 by roll pin 68. Pin depressor 66 can rotate about roll pin 68. Pusher 40, having valve opening member 26, valve detection member 60, retaining ring 62, spring 64, pin depressor 66, and roll pin 68 form dual-valve opening assembly 70. Pin depressor 66 is configured to depress poppet 94 when it rotates about roll pin 68.

Referring to FIG. 7, coupling member 100 is configured so that valve 91 operates as a safety valve and does not open unless service port 8 is inserted into first end 6 of body 4. As coupling member 100 is connected to service port 8, service port 8 is inserted into first end 6. During insertion, sealing gasket 12 forms a fluid-tight seal between coupling member 100 and service port 8. Insertion of port 8 brings pin 14 into contact with valve actuating end 28. Contact occurs during or after sealing gasket 12 forms the fluid-tight seal. Pin 14 of valve 13 opens valve 13 when pressed into the valve by valve actuating end 28 of valve opening member 26. Finally, balls 90 engage with groove 102 of service port 8 when port 8 is inserted into first end 6, attaching coupling member 100 to service port 8.

The position of valve 13 within port 8 can vary within SAE specification. The variation can be as large as 80 thousandths of an inch. FIG. 7 shows valve 13 at the minimum depth within port 8. Valve opening member 26 floats within coupling member 100, allowing it to self-adjust to the position of the valve. Valve opening member 26 can slide in the direction of arrow A by as much as 120 thousandths of an inch to make this adjustment. Spring 36 is less compressible than pin 14 and biases valve opening member 26 toward first end 6. Spring 26 can have a compression of 47.5 lbs/inch and can be, for example, spring LC-0202A-1 from Lee Spring Co. of Brooklyn, N.Y. Thus, as port 8 is inserted into first end 6, valve actuating end 28 presses pin 14 into the valve. When pin 14 has been completely pressed, and valve 13 opens, valve opening member 26 begins to slide in the direction of arrow A, if necessary. This movement allows valve opening member 26 to self-compensate for fluctuations in valve position. Self-compensation can permit the coupling member to safely open valves without damaging them.

The relative positions of balls 90, seal gasket 12, and valve actuating end 28 are important to allow formation of a proper seal between coupling member 100 and port 8 and secure attachment of coupling member 100 to port 8. Seal formation needs to occur before or during valve opening to avoid leakage from the system being serviced because the system can be under pressure. Secure attachment is also important to use the coupling member safely. As depicted in FIG. 7, the distance between the center of ball 90 and the center of seal gasket 12 is represented as dimension B and the distance between the center of ball 90 and valve actuation end 28 when valve opening member 26 is compressed is represented as dimension C. FIG. 6 shows the distance between the center of seal gasket 12 and valve actuation end 28 when valve opening member 26 is fully extended as dimension D. For example, for servicing a low side refrigeration port, dimension B is 311 thousandths of an inch, dimension C is 150 thousandths of an inch, and dimension D is 254 thousandths of an inch. For servicing a high side refrigeration port, dimension B is 276 thousandths of an inch, dimension C is 102 thousandths of an inch, and dimension D is 267 thousandths of an inch.

Coupling member 100 does not open valve 91 when it is not connected to service port 8. As port 8 is inserted into first end 6, valve detection member 60 slides along valve opening member 26, compressing spring 64. The motion of valve detection member 60 moves pin depressor 66 from a first position, shown in FIG. 6 in which valve 91 is closed and pin depressor 66 is within interior chamber 24, to a second position, shown in FIG. 7, in which pin depressor 66 extends partially into second end 18, depressing poppet 94 and opening valve 91. If service port 8 is not inserted into first end 4, then valve detection member 60 will not contact pin depressor 66 and valve 91 will not be opened.

Referring to the embodiment of FIGS. 6 and 7, coupling member 100 includes purge actuator assembly 200. Purge assembly 200 includes cap 202 and shaft 204, which enters opening 206 in body 4 and extends through chamber 24. O-ring 208 provides a fluid-tight seal between shaft 204 and body 4. Shaft 204 extends to pin depressor 66. Spring 210 biases purge assembly 200 away from body 4. When purge assembly 200 is pressed inward, shaft 204 moves pin depressor 66, causing pin depressor 66 to contact poppet 94 and open valve 91. When device 20 is attached to a pressurized fluid source by a conduit, such as a hose, pressing the purge assembly allows air to be vented from the conduit and from the coupling member as the pressurized fluid moves into the coupling member.

A number of embodiments of the invention have been described. Nevertheless, it will be understood that various modifications may be made without departing from the spirit and scope of the invention. Accordingly, other embodiments are within the scope of the following claims.

What is claimed is:

1. A service device comprising:

a body having a first end engageable with a service port including a valve, a second end engageable with a service unit, and an inner surface defining an interior chamber, the first end and the second end being in fluid communication through the interior chamber; and a valve opening member disposed in the interior chamber, the valve opening member including a valve actuating end proximate to the first end, the valve actuating end being capable of changing position relative to the first end, and the valve actuating end being positioned relative to the first end to open the valve as the first end is engaged with the service port.

2. The service device of claim 1, further comprising a spring within the body biasing the valve opening member toward the first end.

3. The service device of claim 2, wherein the valve opening member is arranged to depress a pin within the valve when engaged with the service port, and the spring is less compressible than the pin.

4. The service device of claim 1, further comprising a sealing gasket between the body and the first end, the first end being capable of forming a seal with the port when the first end is engaged with the service port.

5. The service device of claim 1, wherein the first end includes a threaded fitting for engaging the first end with the service port.

6. The service device of claim 1, wherein the first end includes a quick connect fitting for engaging the first end with the service port.

7. The service device of claim 1, wherein the valve opening member is arranged to depress a pin within the valve when engaged with the service port.

8. The service device of claim 1, wherein the first end of the body includes a release sleeve assembly including an adapter connected to the first end of the body, a release sleeve over the adapter, and a spring between the release sleeve and the adapter.

9. The service device of claim 8, wherein the release sleeve assembly includes a plurality of balls distributed between the adapter and the sleeve, the balls being engageable with the service port.

10. The service device of claim 1, further comprising a purge actuator exterior to the body.

11. The service device of claim 1, wherein the body is a portion of a coupling device.

12. The service device of claim 1, wherein the first end is engageable with a high pressure side refrigerant port or a low pressure side refrigerant port.

13. The service device of claim 1, further comprising a pin depressor proximate to the second end having a first position oriented closer to the interior chamber relative to a second position which is closer to the service port, the pin depressor moving from the first position to the second position when the service port is engaged with the first end of the body, and the pin depressor being in the first position when the first end of the body is not engaged with the service port.

14. The service device of claim 13, wherein the pin depressor is movably attached to a pusher disposed in the interior chamber.

15. The service device of claim 13, further comprising a purge actuator exterior to the body, the purge actuator having a shaft extending through the interior chamber to the port, the shaft being capable of moving the pin depressor from the first position to the second position.

16. The service device of claim 13, further comprising a valve positioned within the second end, the valve being opened when the pin depressor moves from the first position to the second position.

17. The service device of claim 13, further comprising a valve detection member movably disposed on a pusher within the internal chamber, the valve detection member moving relative to the pusher when the service port is engaged with the first end of the body, and the pin depressor moving from the first position to the second position when the valve detection member moves relative to the valve actuation portion.

18. The service device of claim 13, further comprising a spring within the body biasing the valve opening member toward the first end.

19. The service device of claim 18, wherein the valve opening member is arranged to depress a pin within the valve when engaged with the service port, and the spring is less compressible than the pin.

20. A coupling member comprising:

a body having a first end engageable with a service port including a first valve, an inner surface defining an interior chamber, and a second end in fluid communication with the interior chamber and the first end;

a valve opening member extending toward the first end of the body movably disposed on a pusher within the interior chamber;

a valve detection member movably disposed on the pusher, the valve detection member moving relative to the pusher when the service port is engaged with the first end of the body and the valve detection member being substantially stationary relative to the pusher when the first end of the body is not engaged with the service port;

a pin depressor movably attached to the pusher and proximate to the second end having a first position oriented closer to the interior chamber relative to a second position which is closer to the second end, the pin depressor moving from the first position to the second position when the valve detection member moves relative to the pusher.

21. The coupling member of claim 20, wherein the first end includes a release sleeve assembly including an adapter connected to the first end, a release sleeve over the adapter, and a spring between the release sleeve and the adapter.

22. The coupling member of claim 21, wherein the release sleeve assembly includes a plurality of balls distributed between the adapter and the sleeve, the balls being engageable with the service port.

23. The coupling member of claim 20, further comprising a purge actuator exterior to the body, the purge actuator having a shaft extending through the interior chamber to the port, the shaft being capable of moving the pin depressor from the first position to the second position.

24. The coupling member of claim 20, further comprising a second valve positioned within the second end, the second valve being opened when the pin depressor moves from the first position to the second position.

25. The coupling member of claim 20, further comprising a spring within the body biasing the valve opening member toward the first end.

26. The coupling member of claim 20, wherein the valve opening member is arranged to depress a pin within the valve when engaged with the service port, and the spring is less compressible than the pin.

27. An air conditioning or refrigeration service device comprising:

a first end engageable with a service port including a valve;

a valve opening member disposed within the service device, the valve opening member including a valve actuating end proximate to the first end, and the valve actuating end being capable of changing position relative to the first end; and a spring within the device biased to position the valve opening member toward the first end.

28. The service device of claim 27, wherein the valve opening member is arranged to depress a pin within the valve when engaged with the service port, and the spring is less compressible than the pin.

29. A method of opening a service port comprising:

adjusting a position of a valve actuating end of a valve opening member relative to a first end of a service port connector, the valve opening member being within the connector and the service port connector being attached to a service unit or being capable of attaching to a service unit and the first end being engageable with the service port; and opening a valve within the service port, wherein the valve actuating end is capable of being positioned relative to the first end to open the valve as the first end is engaged with the port.

30. The method of claim 29, wherein adjusting takes place upon attaching the service port connector to the service port.

31. The method of claim 29, further comprising sealing the connector to the port prior to or concurrently with opening the valve.

32. The method of claim 29, wherein adjusting includes moving the valve opening member relative to the first end against a spring, the spring being biased to position the valve opening member toward the first end.

33. The method of claim 32, wherein the spring is less compressible than a pin in the valve of the service port.

34. A method of servicing a pressurized fluid system comprising attaching a coupling member to a service port of the system, the coupling member including a self-adjusting valve opening member; and opening the service port by attaching the coupling member to the service port.

35. The method of claim 34, wherein the service port is a high pressure side refrigerant port or a low pressure side refrigerant port.

36. The method of claim 34, wherein the coupling member is connected to a service unit.

* * * * *